US009620352B2

(12) United States Patent
Kang et al.

(10) Patent No.: US 9,620,352 B2
(45) Date of Patent: Apr. 11, 2017

(54) ELECTRODELESS LIGHTING DEVICE AND METHOD FOR MANUFACTURING THE SAME

(71) Applicant: LG ELECTRONICS INC., Seoul (KR)

(72) Inventors: Yongdae Kang, Seoul (KR); Jungwon Kang, Seoul (KR); Hyunjung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 493 days.

(21) Appl. No.: 14/108,949

(22) Filed: Dec. 17, 2013

(65) Prior Publication Data

US 2014/0167607 A1 Jun. 19, 2014

(30) Foreign Application Priority Data

Dec. 18, 2012 (KR) ..... 10-2012-0148374

(51) Int. Cl.

| | |
|---|---|
| ***H01J 65/04*** | (2006.01) |
| ***H01J 9/38*** | (2006.01) |
| ***H01J 9/395*** | (2006.01) |
| ***H01J 61/12*** | (2006.01) |

(52) U.S. Cl.

CPC ..... *H01J 65/044* (2013.01); *H01J 9/38* (2013.01); *H01J 9/395* (2013.01); *H01J 61/12* (2013.01)

(58) Field of Classification Search

CPC .. H01J 65/044; H01J 9/38; H01J 9/395; H01J 61/12

See application file for complete search history.

(56) References Cited

U.S. PATENT DOCUMENTS

| | | | |
|---|---|---|---|
| 3,993,379 | A | 11/1976 | Waller |
| 5,216,322 | A | 6/1993 | Fuchs |
| 6,469,444 | B1 | 10/2002 | Leng et al. |
| 2002/0105274 | A1 | 8/2002 | Pothoven et al. |

FOREIGN PATENT DOCUMENTS

| | | | |
|---|---|---|---|
| EP | 0762476 | A1 | 3/1997 |
| EP | 1003204 | A2 | 5/2000 |
| JP | 2002-279937 | A | 9/2002 |

OTHER PUBLICATIONS

Haarsma et al., "The preparation and operation of electrodeless discharge lamps-A critical review", Spectrochimica Acta, vol. 29B, 1974, pp. 1-18, XP55101844A1.

*Primary Examiner* — Joseph L Williams

(74) *Attorney, Agent, or Firm* — Birch, Stewart, Kolasch & Birch, LLP

(57) ABSTRACT

An electrodeless lighting device and methods for manufacturing the same are provided. The method includes inserting a dose into the bulb and at least one of heating a vacuum line for applying a vacuum to the bulb at first predetermined temperature and heating the bulb containing the dose at a second predetermined temperature for a predetermined time.

14 Claims, 7 Drawing Sheets

ELECTRODELESS LIGHTING DEVICE AND METHOD FOR MANUFACTURING THE SAME

Pursuant to 35 U.S.C. §119(a), this application claims the benefit of Korean Patent Application No. 10-2012-0148374, filed on Dec. 18, 2012, which is hereby incorporated by reference as if fully set forth herein.

BACKGROUND OF THE INVENTION

Field of the Invention

The present invention relates to an electrodeless lighting device and a method for manufacturing the same. More specifically, the present invention relates to an electrodeless lighting device and a method for manufacturing the same to reduce a discharge inception voltage and thereby improve initial lighting properties as well as product lifespan and reliability.

Discussion of the Related Art

In general, a lighting device (microwave discharge lamp) using microwaves (microwaves with a wavelength of several hundred MHz to several GHz) is an apparatus that generates visible light by applying microwaves to an electrodeless plasma bulb and has high brightness and high efficiency, when compared to incandescent lamps or fluorescent lamps, and use thereof is gradually increasing.

The microwave lighting device is an electrodeless discharge lamp which includes a quartz bulb filled with inert gas without an electrode and emits visible light of a continuous spectrum while discharging sulfur in a high voltage state and is also referred to as an "electrodeless lighting device".

The electrodeless lighting device includes a magnetron for generating microwaves, a bulb filled with a light-emitting material so as to emit light when excited by the microwaves, a resonator for accommodating the bulb and for resonating the microwaves, and a waveguide for connecting the magnetron to the resonator.

A light emission principle of the electrodeless lighting device will be described in brief. Microwaves generated by the magnetron are transferred through the waveguide to the resonator. The microwaves entering the resonator are resonated in the resonator and, at the same time, excite a light-emitting material of the bulb. The light-emitting material filling the bulb is thus transformed into plasma, thereby generating light which is emitted to the outside of the resonator.

The bulb of the electrodeless lighting device is filled with a dose, such as sulfur, and inert gas for light emission; however, impurities may be introduced to the bulb in the process of filling the dose and inert gas. Problems including increased discharge inception voltage, decreased luminance efficiency and shortened product lifetime of the electrodeless lighting device are encountered if a large amount of impurities are present in the bulb.

SUMMARY OF THE INVENTION

Accordingly, the present invention is directed to an electrodeless lighting device and a method for manufacturing the same that substantially obviate one or more problems due to limitations and disadvantages of the related art.

One object of the present invention is to provide a method for manufacturing an electrodeless lighting device to reduce a discharge inception voltage and thereby improve initial lighting properties.

Another object of the present invention is to provide a method for manufacturing an electrodeless lighting device to increase luminance efficiency and improve product lifespan and reliability.

Another object of the present invention is to provide a method for manufacturing an electrodeless lighting device to reduce a breakdown voltage of a bulb and thereby extend a lifespan of a light source.

Another object of the present invention is to provide a method for manufacturing an electrodeless lighting device to reduce a lighting voltage of a bulb and thereby improve lighting properties and re-lighting properties.

Another object of the present invention is to provide a method for manufacturing an electrodeless lighting device to reduce electric shock of a magnetron upon initial discharge and thereby extend the lifespan of the magnetron.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for manufacturing an electrodeless lighting device including a bulb includes (a) injecting a dose into the bulb, and (b) heating the bulb containing the dose at a first temperature for one hour.

The first temperature may be lower than a boiling point of the dose.

Step (b) may be carried out at 80° C. to 100° C. for 1 to 5 minutes.

The dose may include at least one of sulfur and metal halide.

The metal halide may include at least one selected from the group consisting of calcium bromide ($CaBr_2$), lithium iodide (LiI) and indium bromide (InBr).

In another aspect of the present invention, a method for manufacturing an electrodeless lighting device having a bulb includes (a) heating the bulb at a predetermined temperature for a predetermined time, (b) injecting a dose into the bulb, and (c) heating the bulb containing the dose at a predetermined temperature for a predetermined time.

Step (a) may be carried out at a temperature of 800° C. to 1,000° C. for 30 minutes to 2 hours.

Step (c) may be carried out at a temperature of 800° C. to 1,000° C. for 1 to 5 minutes.

The method may further include heating a vacuum line for applying vacuum to the bulb to a temperature of 150° C. to 200° C., before step (b).

The method may further include, after step (c), changing an atmosphere of a gas line for injecting an inert gas into the bulb to an inert gas atmosphere, and injecting the inert gas into the bulb.

In another aspect of the present invention, a method for manufacturing an electrodeless lighting device having a bulb includes (a) heating a vacuum line for applying vacuum to the bulb, (b) injecting a dose into the bulb; and (c) heating the bulb containing the dose at a predetermined temperature for a predetermined time.

Step (a) may be carried out at a temperature of 150° C. to 200° C.

Step (c) may be carried out at a temperature of 80° C. to 100° C. for 1 to 5 minutes.

The method may further include, after step (c), changing an atmosphere of a gas line for injecting an inert gas into the bulb to an inert gas atmosphere, and injecting the inert gas into the bulb.

In another aspect of the present invention, a method for manufacturing an electrodeless lighting device having a bulb includes (a) heating a vacuum line connected to the bulb at 150° C. to 200° C., (b) heating the bulb at 800° C. to 1,000° C. for 30 minutes to 2 hours, (c) applying vacuum to the bulb, (d) injecting a dose into the bulb, (e) heating the bulb containing the dose at a temperature of 80° C. to 100° C. for 1 to 5 minutes, (f) applying vacuum to the bulb, (g) changing an atmosphere of a gas line connected to the bulb into an inert gas atmosphere, and (h) injecting an inert gas into the bulb.

In another aspect of the present invention, an electrodeless lighting device includes a magnetron for generating microwaves, a waveguide including a waveguide section for accommodating and guiding the microwaves, and an opening for emitting the microwaves, a resonator for receiving the microwaves through the opening, and a bulb disposed in the resonator, wherein the bulb is filled with sulfur, an argon (Ar) gas and a carbon-based (C or $C_2$) gas.

The sulfur may be added in an amount of 14.8 mg, the argon gas may be added to a pressure of 10 to 40 torr, and the electrodeless lighting device may have a power of 1 kW.

The electrodeless lighting device may have a luminance efficiency of 85% or more.

The electrodeless lighting device may have a discharge inception voltage of 900V or less.

The bulb may be filled with a nitrogen-based (N or $N_2$) gas and an oxygen-based (O or $O_2$) gas.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure. In the drawings.

DETAILED DESCRIPTION OF THE INVENTION

Figure 1:
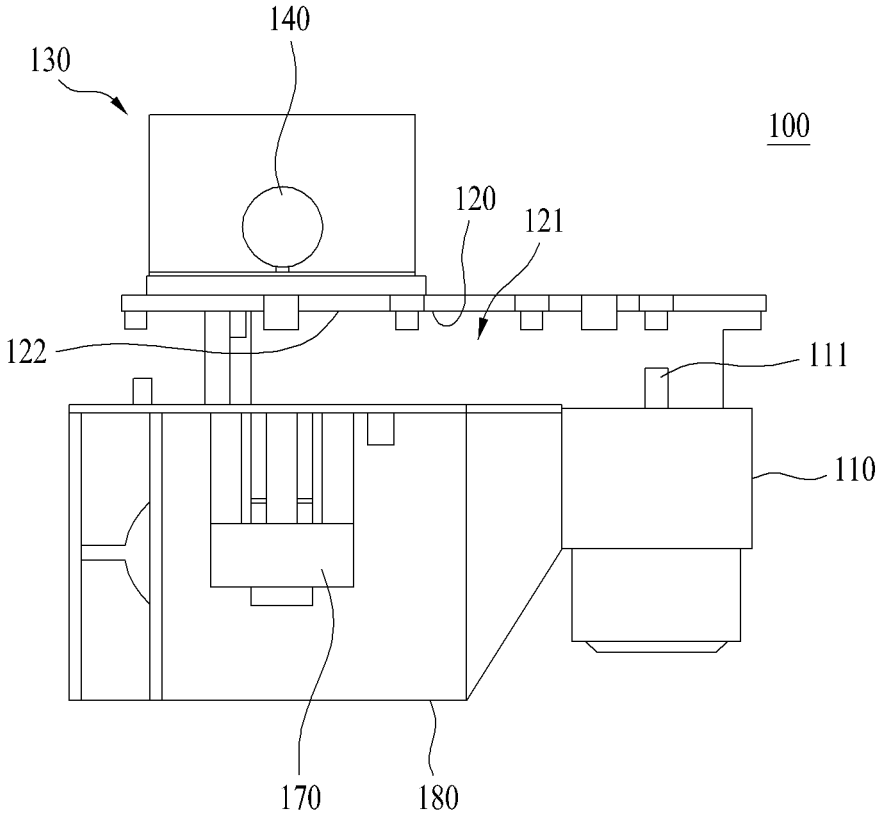
FIG. 1 is a plan view illustrating an inner configuration of an electrodeless lighting device according to an embodiment of the present invention.

Hereinafter, an electrodeless lighting device and a method for manufacturing the same according to embodiments of the present invention will be described in detail with reference to the accompanying drawings. The drawings illustrate exemplary forms of the present invention are provided for more detailed description of the present invention and should not be construed as limiting the technical scope of the present invention.

In addition, the same reference numerals will be used throughout the specification to refer to the same or corresponding parts, regardless of the reference numerals used in drawings, and an overlapping description thereof is omitted. In the drawings, the thickness or size of respective parts is exaggerated or reduced for more clear description.

While the terms first, second, etc. may be used herein to describe various components, these components are not limited by these terms. These terms are used simply to discriminate any one component from other components.

FIG. 1 is a plan view illustrating an inner configuration of an electrodeless lighting device according to an embodiment of the present invention.

The electrodeless lighting device 100 according to an embodiment of the present invention is a device adapted to emit light using microwaves and, thus, may be referred to as microwave lighting device.

Referring to FIG. 1, the electrodeless lighting device 100 includes a magnetron 110 for generating microwaves, a waveguide including a waveguide section 121 for accommodating and guiding the microwaves and an opening 122 for discharging the microwaves, a resonator 130 for receiving the microwaves through the opening 122, and a bulb 140 disposed in the resonator 130 and filled with a light-emitting material. Hereinafter, respective components of the lighting device 100 will be described in detail with reference to the accompanying drawings.

The magnetron 110 generates microwaves of a predetermined frequency and a high voltage generator may be integrated with, or be separately formed from, the magnetron 110. The high voltage generator generates a high voltage and the magnetron 110 generates high frequency microwaves upon receiving the high voltage generated by the high voltage generator.

In addition, the waveguide 120 includes the waveguide section 121 which guides the microwaves generated by the magnetron 110 and the opening 122 for transferring the microwaves to the resonator 130. An antenna unit 111 of the magnetron 110 is inserted into the waveguide section 121 and the microwaves are guided along the waveguide section 121 and are then emitted to the inside of the resonator 130 through the opening 122.

The resonator 130 functions to shield outward discharge of the microwaves introduced therein to create a resonance mode and to generate a strong electric field via excitation of the microwaves. The resonator 130 may have a mesh shape.

The resonator 130 has a first surface facing the opening 122 and a second surface extending from the first surface toward the waveguide 120. In this embodiment, the second surface has a cylindrical shape. The resonator 130 is mounted such that it surrounds the opening 122 of the waveguide 120 and the bulb 140 such that the microwaves pass into the resonator 130 only through the opening 122.

The bulb 140, which is filled with a light-emitting material, is disposed in the resonator 130. The bulb 140 may have a rotating shaft mounted to the motor 170. The motor 170 rotates the bulb 140 and prevents generation of hot spots in certain regions of the bulb 140. The electrodeless lighting device 100 includes a housing 180 surrounding the motor 170.

The light emission principle of the electrodeless lighting device 100 will be described in brief. The microwaves generated by the magnetron 110 are transferred to the resonator 130 through the waveguide 120 and the microwaves entering the resonator 130 are resonated in the resonator and, at the same time, excite the light-emitting material of the bulb 140. The light-emitting material filling the bulb 140 is transformed into plasma to generate light and the light is emitted to the outside of the resonator 130.

In addition, the lighting device 100 may include a reflector (not shown) having a half-spherical shape to control a direction of light emitted from the bulb 140 and guide the light to the outside.

The light-emitting material filling the bulb 140 includes a dose and an inert gas. The dose may include at least one of sulfur and metal halide, and the metal halide may include at least one selected from the group consisting of calcium bromide ($CaBr_2$), lithium iodide (LH) and indium bromide (InBr). Specifically, the dose may include sulfur or metal alone or a combination of a halide and dose. In addition, the inert gas may include argon (Ar).

It is preferable that the bulb 140 is filled with only dose and inert gas; however, in the process of filling the dose and inert gas, impurities may also be introduced the bulb 140. If a large amount of impurities are present in the bulb, problems, such as increased discharge inception voltage, decreased luminance efficiency and shortened product lifetime may result. In order to solve these problems, a novel manufacturing method capable of removing impurities in the process of filling the bulb 140 with dose and inert gas is required.

FIGS. 2 to 5 are flowcharts illustrating methods for manufacturing an electrodeless lighting device according to embodiments of the present invention.

Figure 2:
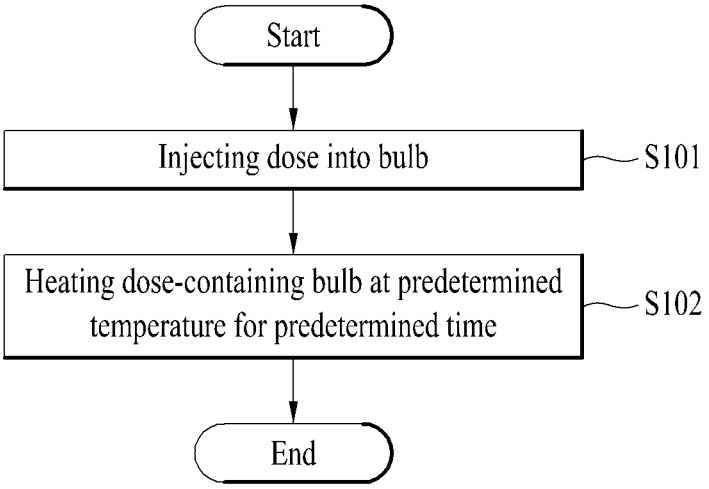
FIGS. 2 to 5 are flowcharts illustrating methods for manufacturing an electrodeless lighting device according to embodiments of the present invention.

Referring to FIG. 2, the method for manufacturing an electrodeless lighting device having a bulb according to the present embodiment includes injecting a dose into the bulb (S101) and heating the bulb containing the dose at a first temperature for a predetermined time (S102), which may be up to an hour. Hereinafter, step (S101) is referred to as the "dose injection step," step (S102) is referred to as the "dose impurity removal step," the predetermined temperature is referred to as the "first temperature," and the predetermined time is referred to as the "first time" for convenience of description.

Before the dose is injected into the bulb 140, the bulb 140 is mounted within a vacuum chamber (not shown). An end of the bulb 140 is opened so as to permit injection of dose and inert gas into the bulb 140. In addition, the vacuum chamber may be provided with a vacuum line for applying vacuum to the bulb 140, a gas line for injecting inert gas into the bulb 140, and a dose injector for injecting the dose. The vacuum chamber may be maintained under argon (Ar) or nitrogen (N) atmosphere. Solely for ease of reference, the methods below may only refer to the use of argon (Ar). As noted above, the dose may include at least one of sulfur and metal halide, and the metal halide may include at least one selected from the group consisting of calcium bromide ($CaBr_2$), lithium iodide (LiI) and indium bromide (InBr).

The first temperature may be lower than a boiling point of the dose. A reason for doing so is that, when the dose is heated to a temperature higher than the boiling point of the dose in order to remove impurities of the dose, at least a portion of the dose becomes evaporated and may be emitted to the outside of the bulb 140. In this case, the content of the dose in the bulb 140 is insufficient and luminance efficiency of the electrodeless lighting device 100 is decreased.

When the dose includes sulfur, step (S102) may be carried out at a temperature of 80° C. to 100° C. for 1 to 5 minutes. Specifically, the first temperature may be 80° C. to 100° C., which is lower than the boiling point of sulfur, and the first time may be 1 to 5 minutes. That is, the step of heating the bulb accommodating the dose at a predetermined temperature for a predetermined time may be carried out at a temperature of 80° C. to 100° C. for 1 to 5 minutes.

The boiling point of sulfur may vary according to vacuum state of the vacuum chamber within a range below the boiling point of sulfur at an atmospheric pressure. Accordingly, a suitable first temperature may be determined within the range of 80° C. to 100° C. according to the vacuum state of the vacuum chamber. In addition, the first time may be within the range of 1 to 5 minutes. For example, the first time may be within the range of 1 to 2 minutes.

The method for manufacturing an electrodeless lighting device according to the above embodiment includes a dose impurity removal step, thus having effects of removing impurities of the bulb as well as impurities of the dose.

Another method for manufacturing an electrodeless lighting device may further include heating the bulb 140 at a second temperature for a second period of time and applying a vacuum to the bulb 140 prior to the step of injecting a dose into the bulb. As a result of the step of heating the bulb 140 at the second temperature for the second period of time, impurities contained in the bulb 140 may be removed before injection of the dose. That is, a method for manufacturing an electrodeless lighting device according to another embodiment includes heating the bulb at a predetermined temperature for a predetermined time, injecting the dose into the bulb and heating the bulb containing the dose at a predetermined temperature for a predetermined time. For example, in one embodiment, the bulb 140 may be made of quartz and, in consideration of a melting point of the quartz, the second temperature may be 800° C. to 1,000° C. and the second predetermined time may be 30 minutes to 2 hours.

Figure 3:
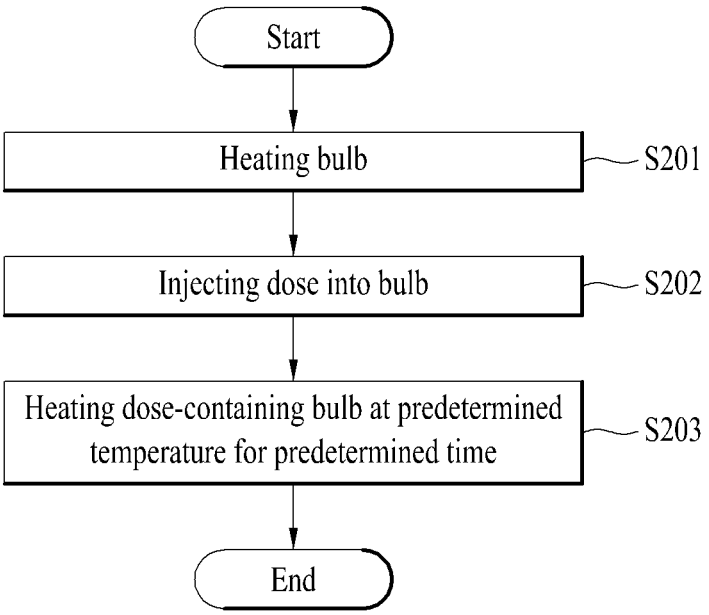

Referring to FIG. 3, the method for manufacturing an electrodeless lighting device according to the embodiment may include heating the bulb (S201), injecting a dose into the bulb (S202) and heating the bulb containing the dose at a predetermined temperature for a predetermined time (S203). Hereinafter, step (S201) may be referred to as "a bulb impurity removal step," step (S202) may be referred to as the "dose injection step" and step (S203) may be referred to as the "dose impurity removal step."

Before injection of the dose into the bulb 140, the bulb 140 is mounted in the vacuum chamber (not shown). An end of the bulb 140 is opened in order to permit injection of dose and inert gas into the bulb 140. Next, impurities contained in the bulb 140 before injection of the dose may be removed through the step of heating the bulb 140. The bulb 140 may be made of quartz and, in consideration of the melting point of quartz, step (S201) may be carried out at a temperature of 800° C. to 1,000° C. for 30 minutes to 2 hours.

As described above, if the dose contains sulfur, step (S203) may be carried out at a temperature of 80° C. to 100° C. for 1 to 5 minutes. Specifically, the first temperature may be 80° C. to 100° C. which is lower than the boiling point of sulfur and the time may be 1 to 5 minutes. As noted above, because the boiling point of sulfur may vary according to vacuum state of the vacuum chamber within a range below the boiling point of sulfur at an atmospheric pressure, a suitable first temperature may be determined within the range of 80° C. to 100° C. according to the vacuum state of the vacuum chamber. In addition, the first time may be determined within the range of 1 to 5 minutes. For example, the first time may be determined to be within the range of 1 to 2 minutes.

Referring to FIG. 3, the method for manufacturing an electrodeless lighting device according to the embodiment includes the bulb impurity removal step and the dose impurity removal step, thus having effects of removing impurities of the bulb as well as impurities of the dose.

Yet another method for manufacturing the electrodeless lighting device 100 may further include heating a vacuum line used for applying a vacuum to the bulb 140 at a third temperature prior to injecting the dose into the bulb. By heating the vacuum line at a predetermined temperature, impurities of the vacuum chamber and the vacuum line can be removed. After impurities present in the vacuum chamber and the vacuum line are removed by heating the vacuum line at the predetermined temperature, the bulb 140 may be mounted in the vacuum chamber and the afore-mentioned the dose injection step and the dose impurity removal step may be performed. The heating of the vacuum line may be carried out at a third temperature between 150° C. and 200° C.

Figure 4:
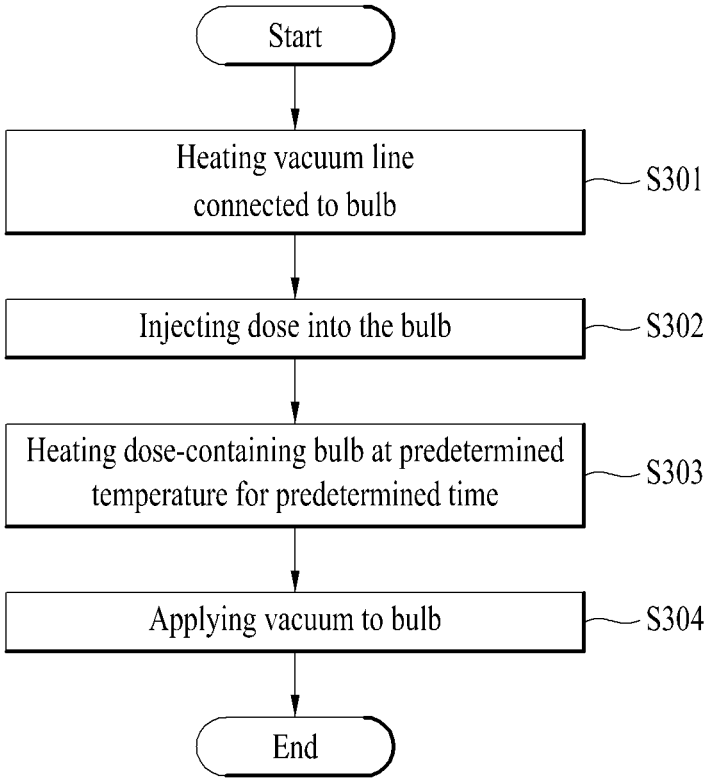

Referring to FIG. 4, the method for manufacturing an electrodeless lighting device according to the embodiment includes heating a vacuum line connected to the bulb 140 (S301), injecting a dose into the bulb 140 (S302), heating the bulb 140 containing the dose at a predetermined temperature for a predetermined time (S303) and applying vacuum to the inside of the bulb 140 (S304).

Regarding step (S301), impurities present in the vacuum chamber and vacuum line can be removed by heating the vacuum line at a predetermined temperature. Specifically, after impurities present in the vacuum chamber and vacuum line are removed by heating the vacuum line at a predetermined temperature, the bulb 140 may be mounted in the vacuum chamber. As noted above step (S301) may be carried out at a temperature of 150° C. to 200° C.

Regarding step (S303), when the dose contains sulfur, as described above, step (S303) may be carried out at a temperature of 80° C. to 100° C. for 1 to 5 minutes. Specifically, the first temperature may be 80° C. to 100° C. which is lower than the boiling point of sulfur and the time may be 1 to 5 minutes. As noted above, because the boiling point of sulfur may vary according to vacuum state of the vacuum chamber within a range below the boiling point of sulfur at an atmospheric pressure, a suitable first temperature may be determined within the range of 80° C. to 100° C. according to the vacuum state of the vacuum chamber. In addition, the first time may be determined within the range of 1 to 5 minutes. For example, the first time may be determined to be within the range of 1 to 2 minutes.

In addition, step (S304) may be simultaneously or sequentially performed with step (S303) of heating the bulb 140 containing the dose at a predetermined temperature for a predetermined time. In one embodiment, the bulb containing the dose 140 is heated at a predetermined temperature for a predetermined time and, at the same time, a vacuum may be applied to the bulb 140 so as to discharge impurities to the outside of the bulb 140. Step (S304) may be referred to as the "bulb pumping step".

Meanwhile, the method for manufacturing the electrodeless lighting device 100 may further include, after the dose impurity removal step, changing an atmosphere of a gas line for injecting an inert gas into the bulb into an inert gas atmosphere and injecting the inert gas into the bulb 140. For example, in the step of changing an atmosphere of a gas line for injecting an inert gas into the bulb 140 into an inert gas atmosphere, the atmosphere of the gas line can be transformed into an inert gas and can be maintained thereat, and injection of impurities together with the inert gas into the bulb 140 can be prevented in the step of injecting the inert gas by injecting inert gas to the gas line several times before injection of inert gas into the bulb 140. The inert gas may be argon (Ar).

Figure 5:
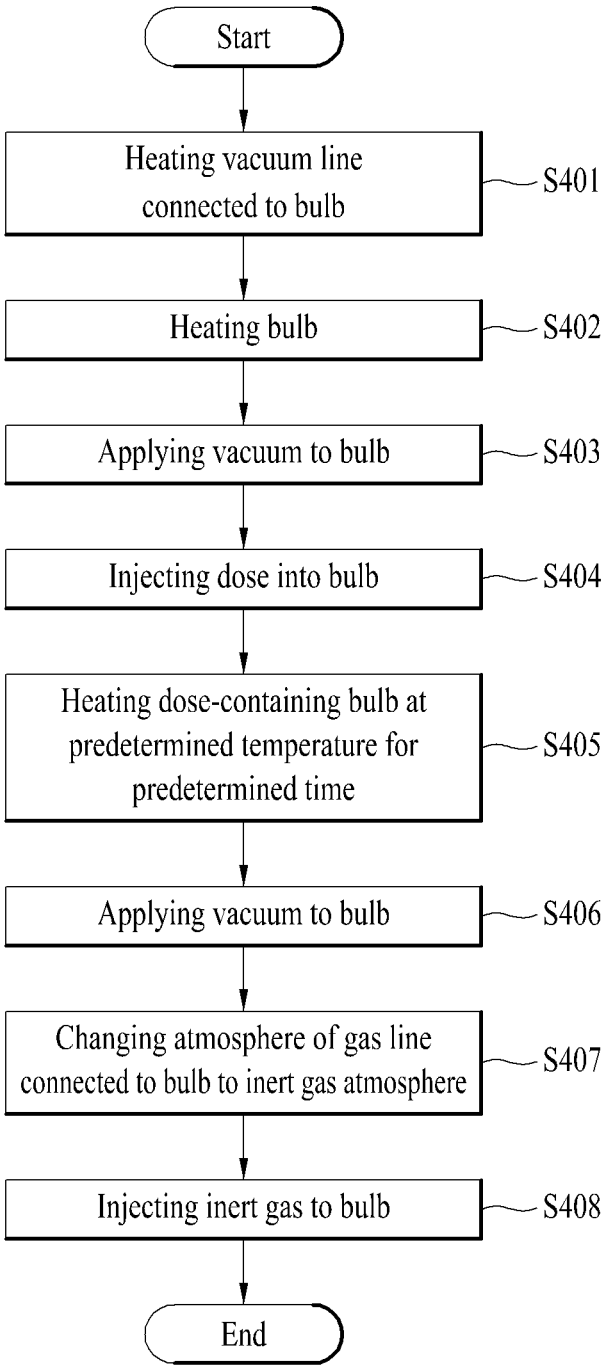

Referring to FIG. 5, the method for manufacturing an electrodeless lighting device according to the embodiment includes heating a vacuum line connected to the bulb (S401), heating the bulb (S402), applying a vacuum to the bulb (S403), injecting a dose into the bulb (S404), heating the bulb containing the dose at a predetermined temperature for a predetermined time (S405), applying a vacuum to the inside of the bulb (S406), changing an atmosphere of the gas line connected to the bulb to an inert gas atmosphere (S407) and injecting inert gas to the inside of the bulb (S408).

Regarding step (S401), impurities present in the vacuum chamber and vacuum line can be removed by heating the vacuum line at a predetermined temperature. Specifically, after impurities present in the vacuum chamber and the vacuum line are removed by heating the vacuum line at the predetermined temperature, the bulb 140 may be mounted in the vacuum chamber. Step (S401) may be carried out at a temperature of 150° C. to 200° C. While steps have been shown in a particular order, it is understood that the steps do not need to be performed in precisely the order shown. For example, step (S401) need only be performed before step (S404) of injecting the dose into the bulb.

Regarding the steps of heating the bulb (S402) and applying vacuum to the inside of the bulb (S403), impurities contained in the bulb 140 before injection of the dose may be removed through heating the bulb 140. Because the bulb 140 may be made of quartz and, in consideration of the melting point of the quartz, step (S402) may be performed at a temperature of 800° C. to 1,000° C. for 30 minutes to 2 hours. In addition, the bulb containing the dose 140 is heated at a predetermined temperature for a predetermined time and, at the same time, vacuum may be applied to the bulb 140 so as to discharge impurities to the outside of the bulb 140 in a similar manner as to that described above. For example, regarding step (S405), when the dose contains sulfur, as described above, step (S405) may be may be carried out at a temperature of 80° C. to 100° C. for 1 to 5 minutes. Specifically, the first temperature may be 80° C. to 100° C. which is lower than the boiling point of sulfur and the time may be 1 to 5 minutes. As noted above, because the boiling point of sulfur may vary according to vacuum state of the vacuum chamber within a range below the boiling point of sulfur at an atmospheric pressure, a suitable first temperature may be determined within the range of 80° C. to 100° C. according to the vacuum state of the vacuum chamber.

In addition, step (S406) may be simultaneously or sequentially performed with step (S405) of heating the bulb 140 containing the dose at a predetermined temperature for a predetermined time. In one embodiment, the bulb containing the dose 140 is heated at a predetermined temperature for a predetermined time and, at the same time, a vacuum may be applied to the bulb 140 so as to discharge impurities to the outside of the bulb 140.

Regarding steps (S407) and (S408), in the step of changing an atmosphere of a gas line for injecting an inert gas into the bulb 140 into an inert gas atmosphere, the atmosphere of the gas line can be transformed into an inert gas and can be maintained thereat, and injection of impurities together with the inert gas into the bulb 140 can be prevented in the step of injecting the inert gas by injecting inert gas to the gas line several times before injection of inert gas into the bulb 140. The inert gas may be argon (Ar).

In summary, the method for manufacturing an electrodeless lighting device, according to the embodiment shown in FIG. 5, may include (a) heating a vacuum line connected to the bulb at 150° C. to 200° C., (b) heating the bulb at 800° C. to 1,000° C. for 30 minutes to 2 hours, (c) applying a vacuum to the bulb, (d) injecting a dose into the bulb, (e) heating the bulb containing the dose at a temperature of 80° C. to 100° C. for 1 to 5 minutes, (f) applying a vacuum to the bulb, (g) changing an atmosphere of a gas line connected to the bulb to an inert gas atmosphere, and (h) injecting an inert gas into the bulb.

Figure 6:
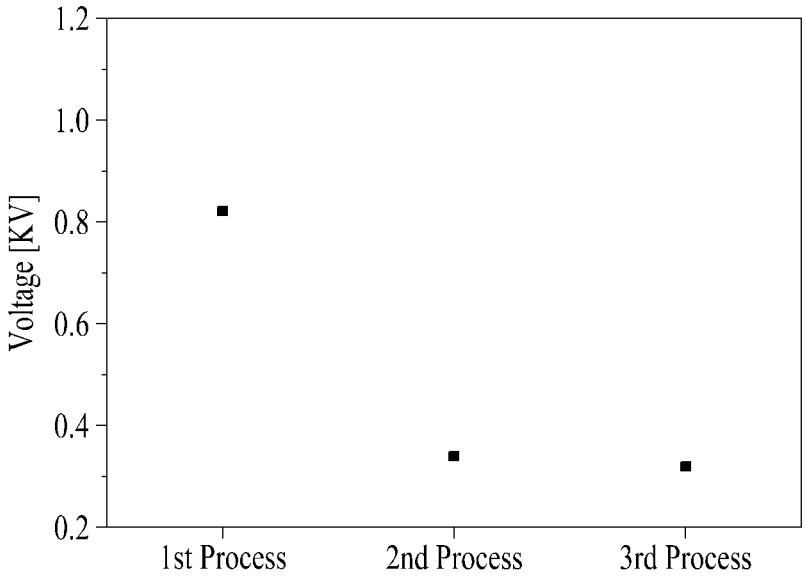
FIGS. 6 and 7 are graphs illustrating effects of the method for manufacturing an electrodeless lighting device according to embodiments of the present invention.
Figure 7:
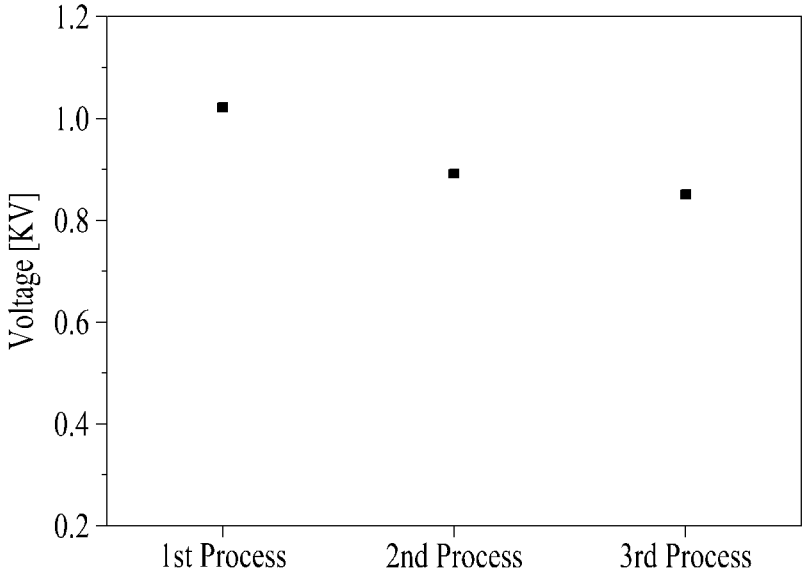

FIGS. 6 and 7 are graphs illustrating effects of the method for manufacturing an electrodeless lighting device according to embodiments of the present invention. In addition, FIG. 8 is a graph showing luminance efficiency of the electrodeless lighting device according to the embodiment.

Figure 8:
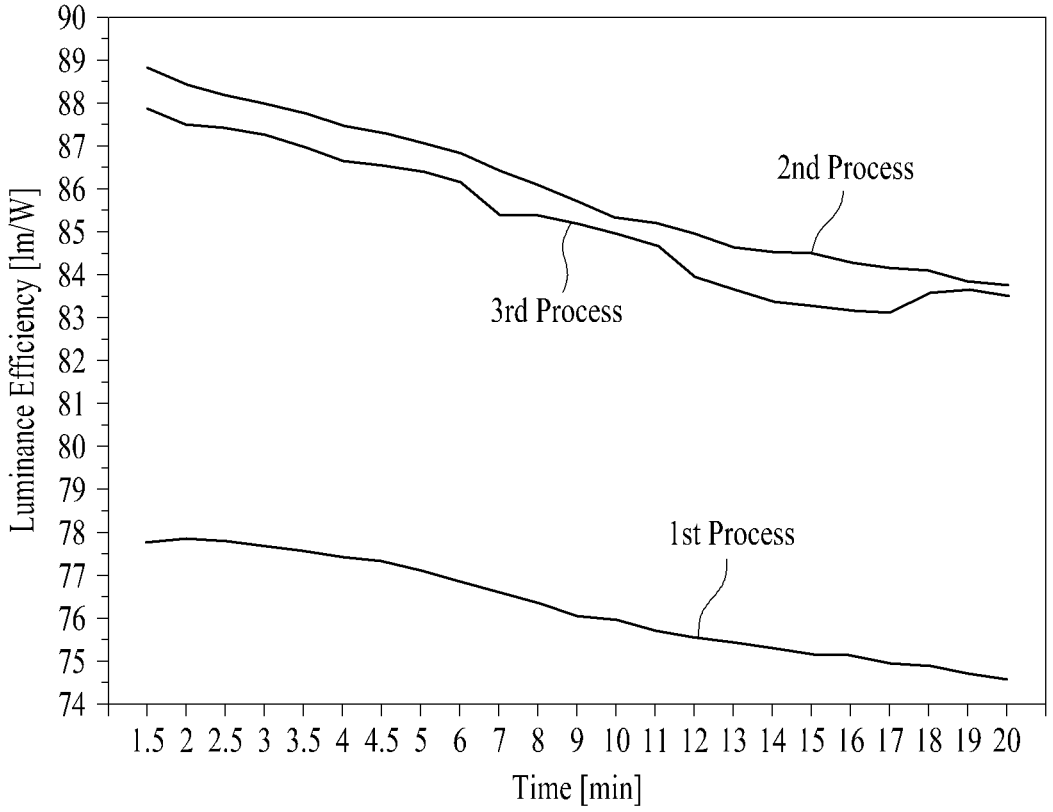
FIG. 8 is a graph showing luminance efficiency of the electrodeless lighting device according to embodiments of the present invention.

A first process shown in FIGS. 6, 7 and 8 may include heating the bulb, applying a vacuum to the inside of the bulb, injecting a dose into the bulb, applying a vacuum to the inside of the bulb and injecting inert gas into the bulb. The first process may further include remaining steps described with reference to FIGS. 2 to 5, but does not include heating the vacuum line connected to the bulb and heating the bulb containing the dose at a predetermined temperature for a predetermined time.

The second process includes heating the vacuum line connected to the bulb, heating the bulb, applying a vacuum to the inside of the bulb, injecting a dose into the bulb, applying a vacuum to the inside of the bulb and injecting inert gas into the bulb.

The third process includes heating the vacuum line connected to the bulb, heating the bulb, applying a vacuum to the inside of the bulb, injecting a dose into the bulb, heating the bulb containing the dose at a predetermined temperature for a predetermined time, applying vacuum to the inside of the bulb and injecting inert gas into the bulb.

For each of the first to third processes, testing is performed under conditions that the bulb is filled with 14.8 mg of sulfur, argon gas is injected to a pressure of 10 torr, and a power of the electrodeless lighting device is 1 kW. Meanwhile, the weight of sulfur may be changed according to power of the electrodeless lighting device and desired color temperature.

FIG. 6 shows the first discharge inception voltage of the electrodeless lighting device 100. The electrodeless lighting device manufactured by the first process, which does not include the steps of heating the vacuum line connected to the bulb and heating the bulb containing the dose, has an initial discharge voltage of about 830V; the electrodeless lighting device manufactured by the second process, which does not include the step of heating the bulb containing the dose, has an initial discharge voltage of about 340V; and the electrodeless lighting device manufactured by the third process, which includes the step of heating the bulb containing the dose has an initial discharge voltage of about 300V.

As seen from FIG. 6, when heating of the vacuum line connected to the bulb and/or heating of the bulb containing the dose are performed, the initial discharge voltage of the electrodeless lighting device can be advantageously reduced by about 70% to 80%.

FIG. 7 shows a lighting inception voltage after the first discharge of the electrodeless lighting device 100. The electrodeless lighting device manufactured by the first process, which does not include the steps of heating the vacuum line connected to the bulb and heating the bulb containing the dose, has an initial discharge voltage of about 1,000V; the electrodeless lighting device manufactured by the second process, which does not include the step of heating the bulb containing the dose, has an initial discharge voltage of about 900V; and the electrodeless lighting device manufactured by the third process, which includes the step of heating the bulb containing the dose, has an initial discharge voltage of about 850V.

As can be seen from FIG. 8, the electrodeless lighting device manufactured by the first process has a luminance efficiency of about 77.57%, the electrodeless lighting device manufactured by the second process has a luminance efficiency of about 87.8% and the electrodeless lighting device manufactured by the third process has a luminance efficiency of about 87%. As such, the electrodeless lighting device manufactured by the second or third process may have a luminance efficiency of 80% or more. More particularly, the electrodeless lighting device manufactured by the second or third process may have a luminance efficiency of 85% or more. And more particularly, the electrodeless lighting device manufactured by the second or third process may have a luminance efficiency of 87% or more. On the other hand, the electrodeless lighting device manufactured by the first process has a luminance efficiency lower than 80%.

As described above, in accordance with the method for manufacturing an electrodeless lighting device related to the embodiment of the present invention, it is possible to reduce discharge inception voltage and thereby improve initial lighting properties. In addition, in accordance with the method for manufacturing an electrodeless lighting device related to the embodiment, it is possible to increase luminance efficiency and thereby improve product lifespan and reliability.

Figure 9A:
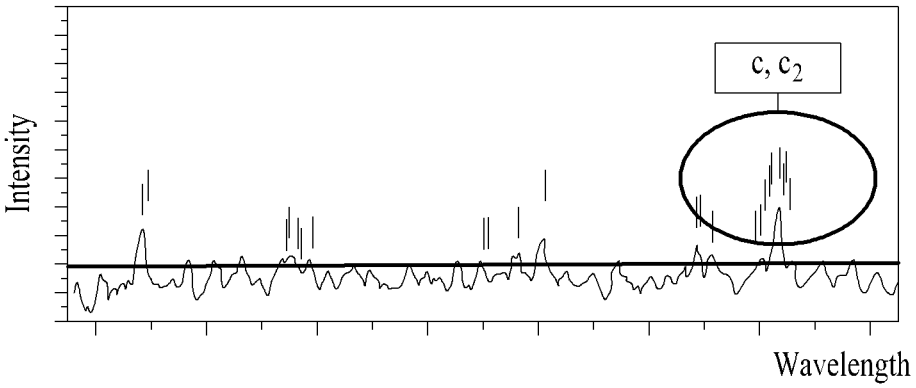
FIGS. 9A and 9B are graphs illustrating impurities present in the bulb according to the methods for manufacturing an electrodeless lighting device according to the embodiments of the present invention.
Figure 9B:
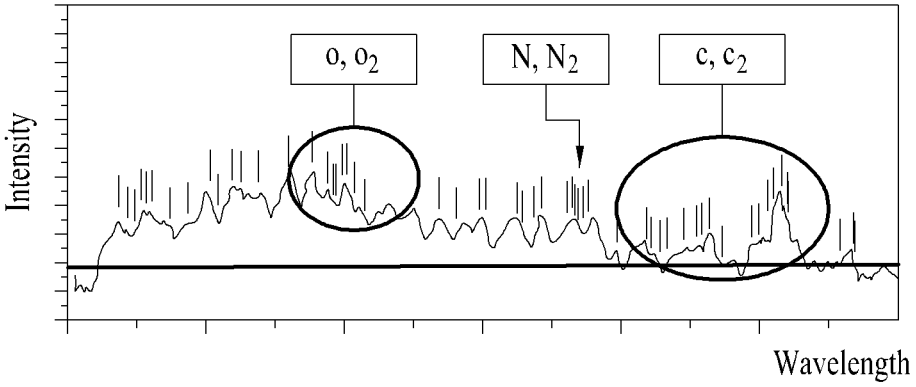

FIGS. 9A and 9B are graphs illustrating impurities present in the bulb depending on the methods for manufacturing an electrodeless lighting device related to the embodiments. For example, FIG. 9A is a graph showing gas components in the bulb of the electrodeless lighting device manufactured by a method including heating the bulb containing the dose and FIG. 9B is a graph showing gas components in the bulb of the electrodeless lighting device manufactured by a method not including heating the bulb containing the dose. Components detected at individual wavelengths can be seen from respective graphs.

As can be seen from FIG. 9A, carbon-based (C, $C_2$) substances are observed according to wavelength ranges and these substances are derived from quartz, which is the material of the bulb.

As can be seen from FIG. 9B, carbon-based (C, $C_2$) substances, oxygen-based (O, $O_2$) substances and nitrogen-based (N, $N_2$) substances are further observed according to wavelength ranges. That is, it can be seen that a variety of types of impurities are present in the bulb of the electrodeless lighting device manufactured by the method not including heating the bulb containing the dose.

Hereinafter, the electrodeless lighting device manufactured by the methods described above will be described. Referring again to FIG. 1, the electrodeless lighting device 100 includes a magnetron 110 for generating microwaves, a waveguide 120 including a waveguide section 121 for accommodating and guiding the microwaves, and an opening 122 for emitting the microwaves, a resonator 130 for receiving the microwaves through the opening 122, and a bulb 140 disposed in the resonator.

The bulb is manufactured by the method described with reference to FIGS. 2 to 5. That is, the bulb 140 may be filled with sulfur, argon (Ar) gas, and carbon-based (C, C2) gases (see FIG. 9A). The sulfur may be added in an amount of 14.8 mg, the argon gas may be added to a pressure of 10 or 40 torr, and the electrodeless lighting device may have a power of 1 kW. In addition, the electrodeless lighting device may have a luminance efficiency of 85% or more and the electrodeless lighting device may have a discharge inception voltage of 900V or less. Alternatively, the bulb may be filled with nitrogen-based (N, $N_2$) gas and oxygen-based (O, $O_2$) gas (see FIG. 9B).

As apparent from the foregoing, and in accordance with the methods for manufacturing an electrodeless lighting device according to embodiments of the present invention, discharge inception voltage can be reduced and initial lighting properties can be thus improved.

In addition, in accordance with the methods for manufacturing an electrodeless lighting device according to embodiments of the present invention, luminance efficiency can be increased and product lifespan and reliability can be improved.

In addition, in accordance with the methods for manufacturing an electrodeless lighting device according to embodiments of the present invention, lifespan of a light source can be extended by reducing breakdown voltage of a bulb.

In addition, in accordance with the methods for manufacturing an electrodeless lighting device according to embodiments of the present invention, lighting properties and re-lighting properties can be improved by reducing a lighting voltage of the bulb.

In addition, in accordance with the methods for manufacturing an electrodeless lighting device according to embodiments of the present invention, an electric shock of a magnetron upon initial discharge is reduced and lifespan of the magnetron is thus extended.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for manufacturing an electrodeless lighting device having a bulb, the method comprising:

(a) inserting a dose into the bulb; and (b) heating the bulb containing the dose at a first temperature for a first predetermined time, wherein the first temperature ranges from 80° C. to 100° C.

2. The method according to claim 1, wherein the first temperature is lower than a boiling point of the dose.

3. The method according to claim 1, wherein the first predetermined time ranges from 1 to 5 minutes.

4. The method according to claim 1, wherein the dose comprises at least one of sulfur and a metal halide.

5. The method according to claim 4, wherein the metal halide comprises at least one selected from the group consisting of calcium bromide ($CaBr_2$), lithium iodide (LiI) and indium bromide (InBr).

6. A method for manufacturing an electrodeless lighting device having a bulb, the method comprising:

(a) heating the bulb at a first predetermined temperature for a first predetermined time;

(b) inserting a dose into the bulb;

(c) heating the bulb containing the dose at a second predetermined temperature for a second predetermined time; and (d) applying a vacuum to an inside of the bulb so as to discharge impurities to an outside of the bulb.

7. The method according to claim 6, wherein the first predetermined temperature ranges from 800° C. to 1,000° C. and the first predetermined time ranges from 30 minutes to 2 hours.

8. The method according to claim 7, wherein the second predetermined temperature ranges from 80° C. to 100° C. and the second predetermined time ranges from 1 to 5 minutes.

9. The method according to claim 6, further comprising heating a vacuum line for applying a vacuum to the bulb at a temperature of 150° C. to 200° C. before step (b) is performed.

10. The method according to claim 6, further comprising, after step (c):

changing an atmosphere of a gas line for injecting an inert gas into the bulb to an inert gas atmosphere; and injecting an inert gas into the bulb.

11. A method for manufacturing an electrodeless lighting device having a bulb, the method comprising:

(a) inserting a dose into the bulb;

(b) heating a vacuum line for applying a vacuum to the bulb at a first predetermined temperature and heating the bulb containing the dose at a second predetermined temperature for a predetermined time;

(c) after heating the bulb containing the dose at the second predetermined temperature for the predetermined time, changing an atmosphere of a gas line for injecting an inert gas into the bulb to an inert gas atmosphere; and (d) injecting an inert gas into the bulb.

12. The method according to claim 11, wherein the first predetermined temperature ranges from 150° C. to 200° C.

13. The method according to claim 12, wherein the second predetermined temperature ranges from 80° C. to 100° C. and the predetermined time ranges from 1 to 5 minutes.

14. A method for manufacturing an electrodeless lighting device having a bulb, the method comprising:

(a) heating a vacuum line connected to the bulb at 150° C. to 200° C.;

(b) heating the bulb at 800° C. to 1,000° C. for 30 minutes to 2 hours;

(c) applying a vacuum to the bulb;

(d) inserting a dose into the bulb;

(e) heating the bulb containing the dose at a temperature of 80° C. to 100° C. for 1 to 5 minutes;

(f) applying another vacuum to the bulb;

(g) changing an atmosphere of a gas line connected to the bulb to an inert gas atmosphere; and (h) injecting an inert gas into the bulb.

* * * * *